United States Patent [19]

Tsui

[11] 4,282,678

[45] Aug. 11, 1981

[54] TOY TO SIMULATE HEARTBEATS AND A STETHOSCOPE

[75] Inventor: Kwok W. Tsui, Wanchai, Hong Kong

[73] Assignee: Arco Industries, Ltd., Kowloon, Hong Kong

[21] Appl. No.: 143,854

[22] Filed: Apr. 25, 1980

[51] Int. Cl.[3] ..... A63H 5/00; A63H 29/16

[52] U.S. Cl. ..... 46/175 R; 46/44

[58] Field of Search ..... 46/44, 178, 175 R, 1 R, 46/175 AR, 175 R; 35/17; D24/20; 181/131; 128/684, 677

[56] References Cited

U.S. PATENT DOCUMENTS

| | | | |
|---|---|---|---|
| 369,404 | 9/1887 | Heston et al. | 273/141 R |
| 2,571,124 | 10/1951 | Farrand | 128/684 |
| 2,715,296 | 8/1955 | Pettit | 46/175 R |
| 3,024,568 | 3/1962 | Barnett | 46/39 |
| 3,093,925 | 6/1963 | Greene | 46/8 |
| 3,172,232 | 3/1965 | Bischoff | 46/178 |
| 3,470,745 | 10/1969 | Frank | 128/684 |
| 3,621,845 | 11/1971 | Oates | 181/131 |
| 4,155,196 | 5/1979 | Bollinger et al. | 46/175 R |
| 4,174,588 | 11/1979 | Clanton | 46/44 |
| 4,177,871 | 12/1979 | Clanton | 181/131 |

*Primary Examiner*—Gene Mancene
*Assistant Examiner*—Michael J. Foycik, Jr.
*Attorney, Agent, or Firm*—C. Hercus Just

[57] ABSTRACT

A toy stethoscope including a flexible yoke with earpieces on the outer ends of the arms thereof, flexible tubes respectively extending along the arms from the earpieces to one end of a cylinder having a reciprocable plunger therein to produce sounds simulating natural heartbeats, another tube connected at one end to the other end of the cylinder and the other end of the tube being connected to a bellows element adapted to be manually operated to compress and release one end of the same to successively produce air pressure and suction operable upon the plunger to effect the sounds simulating natural heartbeats.

4 Claims, 5 Drawing Figures

TOY TO SIMULATE HEARTBEATS AND A STETHOSCOPE

BACKGROUND OF THE INVENTION

Medical type toys of many types have fascinated children for a long time and one particular type of toy that is of special interest to them is a stethoscope, particularly if the same is provided with means to produce sounds simulating a natural heartbeat of a person or animal. A number of types of such devices have been developed heretofore in an effort to satisfy the need for such a toy, one example of the same comprising the subject matter of recent U.S. Pat. No. 4,155,196 to Bollinger et al, dated May 22, 1979, in which a doll or other toy animal has a permanent magnet concealed therein in the location of a heart and a toy stethoscope includes a probe containing therein a normally opened reed switch which is closed to produce a heartbeat-like sound when the probe is near the magnet. Such a device obviously is relatively sophisticated and somewhat expensive to produce.

Since it is one object of the present invention to provide a device which requires no auxiliary energy, such as an electric current, the present invention includes, among other items, a bellows element which can be manually operated to produce the desired sound. In this regard, in a broad sense, it is old to produce a compressible bulb or bellows-like elements to accomplish certain features in toys of different types. One early example of the same comprises the subject matter of U.S. Pat. No. 369,404 to Heston et al, dated Sept. 6, 1887, in relation to a chance device. Another more recent patent employing a compressible bellows is the subject matter of U.S. Pat. No. 3,093,925 to Greene, dated June 18, 1963, which pertains to a bubble-making toy, having a bellows included therein.

Still another toy somewhat in the simulated medical field is the subject matter of recent U.S. Pat. No. 4,174,588 to Clanton, dated Nov. 20, 1979, in which a toy blood pressure monitoring device includes a compressible bulb, operable against a rotatable vaned member associated with an arm band adapted to be wrapped around the arm of a human and compression and release of the bulb operates a dial.

The present invention has been developed in an attempt to produce a relatively realistic stethoscope with which a sound-producing element is involved to include certain characteristics of medical equipment and, incidentally, produce a sound simulating a heartbeat, the structure of which is believed to be an improvement over the prior devices and details of which are set forth below.

SUMMARY OF THE INVENTION

It is among the principal objects of the present invention to provide a toy stethoscope associated with sound-producing mechanism simulating the sound of a natural heartbeat, said mechanism being operated by a relatively simple accordian-like bellows, closed at one end and connected by a tube from the other end to said sound-producing mechanism, whereby the closed end of the bellows element may be applied against the body of a doll or a human, and by reciprocating the bellows, the sound-generating mechanism produces a relatively natural-sounding heartbeat, said sound being transmitted to earpieces respectively on the outer ends of the arms of a flexible yoke, which also includes tube means extending from said earpieces to said sound-producing mechanism.

It is another object of the invention to provide a toy of the type described above in which as many of the components as possible are formed from plastic material in order that the components may be accurately reproduced inexpensively and readily assembled into a completed toy.

A further object of the invention is to partially contain the accordian-like bellow element in a cup-shaped member connected to the end of the bellows element from which a tube extends to the sound-producing mechanism for purposes of reciprocating a plunger therein that actually is the means by which the simulated heartbeat sound is produced as the plunger is reciprocated within a cylinder having preferably a transparent panel upon which scale lines are formed for permitting simulated readings relative to a mark or indicia upon the plunger.

Details of the foregoing objects and of the invention, as well as other objects thereof, are set forth in the following specification and illustrated in the accompanying drawing comprising a part thereof.

DETAILED DESCRIPTION OF THE PREFERRED EMBODIMENT

Figure 1:
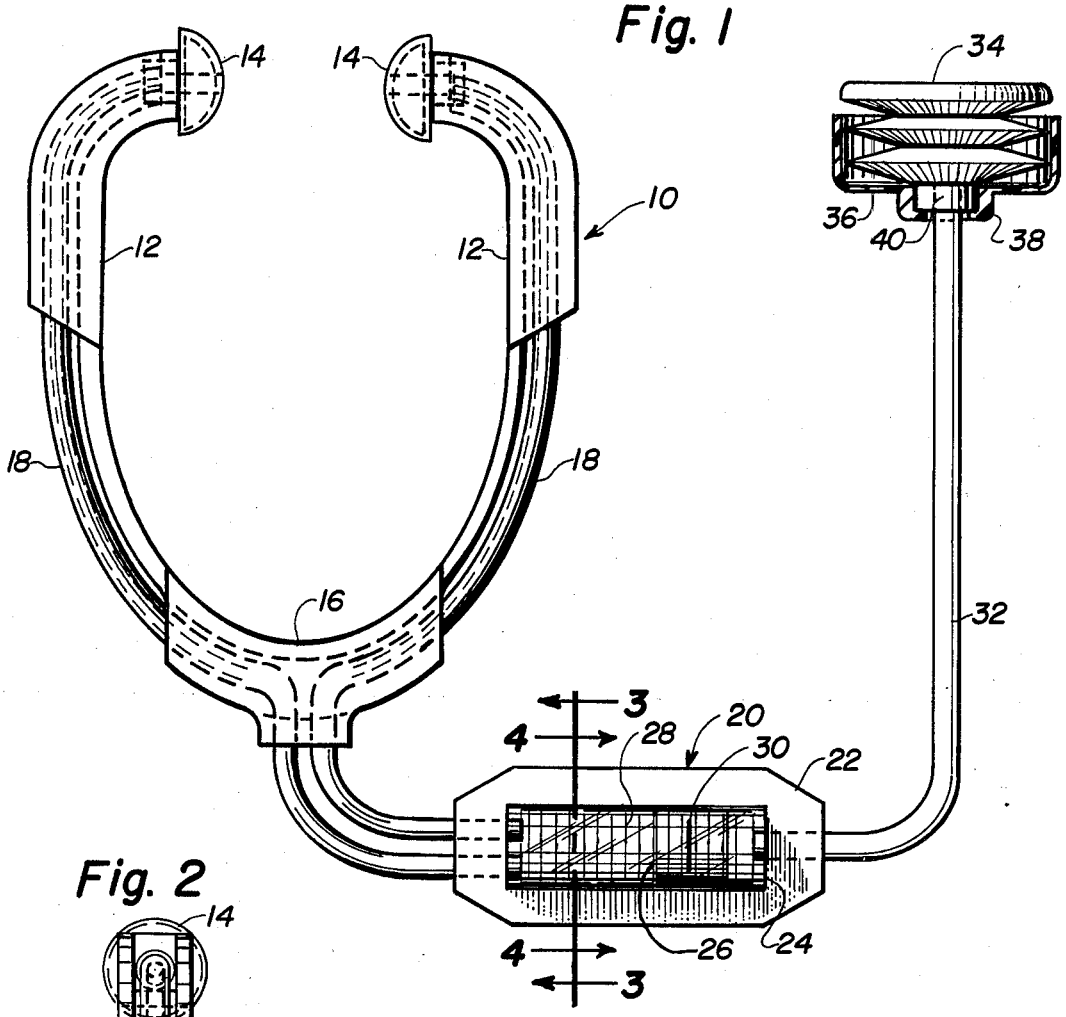
FIG. 1 is a plan view of a toy stethoscope and sound-producing mechanism which also is connected to a bellows element, partially enclosed in a cup, which is shown in transverse section.
Figure 2:
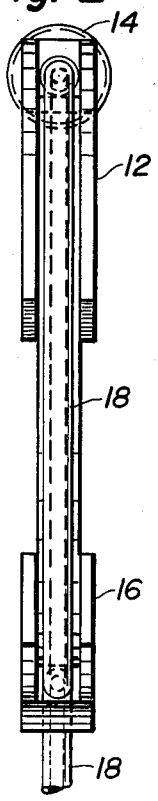
FIG. 2 is a side view of the yoke of the stethoscope per se, the tubes leading from the stethoscope being illustrated fragmentarily.
Figure 3:
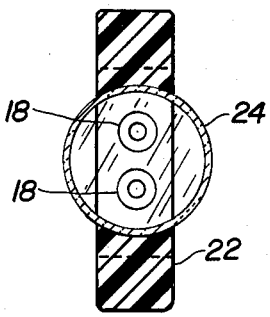
FIGS. 3 and 4 respectively are transverse sectional views taken on the lines 3—3 and 4—4 of FIG. 1.
Figure 4:
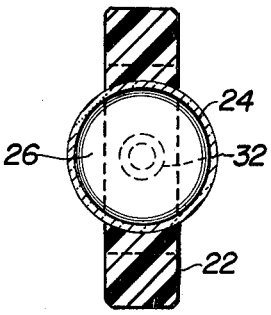

Referring to FIG. 1, the toy stethoscope 10 comprises a yoke of limited flexibility and preferably molded from appropriate plastic material which forms the arms 12, which are channel-like in cross-section, especially in the outer end portions thereof, said ends having flexible rubber-like earpieces 14 mounted therein. The arms 12 are connected by a junction member 16 which, as especially can be seen from the side view comprising FIG. 2, is channel-shaped, as in the outer end portions of the arms 12, as also can be seen from FIG. 2, for purposes of accommodating respectively in said arms and junction member, a pair of flexible branch tube members 18, which project from the lower end of the junction member 16 in parallel relationship, said tubes extending to one end of a sound-producing mechanism in the form of a unit 20.

The mechanism of sound-producing unit 20 includes a molded body 22 provided with suitable openings in the left-hand end, as viewed in FIG. 1, to have the terminal ends of the branch tube members 18 mounted therein for communication with the interior of a molded cylinder 24, which has at least a transparent elongated panel therein for purposes of viewing the reciprocating movements of a plunger 26, which is freely but preferably closely slidably mounted within the cylinder 24, due to the fact that the same is reciprocated by means of air pressure and suction alternately in reverse directions within the cylinder. Preferably, the molded body 22, cylinder 24 and plunger 26 are formed from plastic material, and at least the transparent panel referred to above as being on cylinder 24, has gradient or scale lines 28 formed thereon to simulate the rate of heartbeat or the like, depending upon the imagination of the child or other individual playing with the stethoscope. To render the device more life-like, the plunger 26 also has a reference line 30 formed thereon.

The right-hand end of the molded body 22 has one end of a single flexible tube 32 mounted therein for communication with the interior of the cylinder 24, the opposite end of the tube 32 being connected to one end of an accordian-type bellows element 34 formed of plastic material of a self-restoring nature, and which is flexible in order that the bellows element may be compressed to inject air pressure into the tube 32 against one end of the plunger 26 and cause the same to move toward the left, as viewed in FIG. 1 within said cylinder, whereas when the upper or closed end of bellows element 34 as viewed in FIG. 1, is released, the self-restoring inherent nature of the plastic material from which the bellows is formed, will cause it to expand to the condition as shown, for example, in exemplary manner in FIG. 1, and thereby effect a suction to be caused within the tube 32, and thereby move the plunger 26 toward the right-hand end of the cylinder 24, as viewed in FIG. 1.

For purposes of convenience of operation, the bellows element 34 preferably is partially enclosed within a preferably rigid cup-like member 36, which also conveniently may be molded from appropriate plastic material and is provided with a boss 38 through which said one end of the tube 32 extends for reception within a similar boss-like projection 34 through which the adjacent end of the tube 32 extends for communication with the interior of the bellows element 34, which otherwise is closed.

Figure 5:
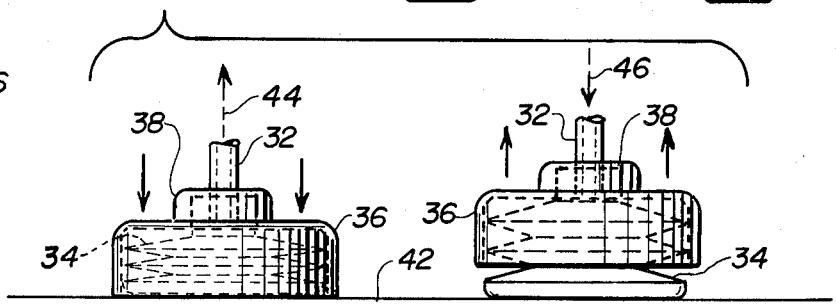
FIG. 5 is a diagrammatic figure respectively showing two views of the bellows and cup shown in FIG. 1, one view showing the bellows compressed to produce air pressure in a tube fragmentarily connected thereto, and the second view showing the bellows expanded and producing suction in said fragmentarily illustrated tube connected thereto, said views also showing direction arrows, illustrating movement of the cup associated with the bellows element.

For purposes of simulating a somewhat life-like operation of the bellows element 34, attention is directed to FIG. 5, in which at the left-hand side, it will be seen that the cup-like member 34 has moved against an operating surface 42, such as part of a human body, a doll, or toy animal, for purposes of compressing the bellows element 34, and thereby, generates air pressure as indicated by the arrow 44, the manipulation of the cup-like member 36 being effected manually. When said member is released as viewed in the right-hand side of FIG. 5, the self-restoring nature of the bellows element 34 enables it to expand and thereby create suction as indicated by the arrow 46, other arrows in said illustrations in FIG. 5 representing in the left-hand figure, the compressive movement of the member 36, while in the right-hand figure, they represent the released movement of member 36.

It will be seen from the foregoing, therefore, that the toy comprising the present invention produces in life-like fashion simulated heartbeats which result from the operation of the sound-producing unit or mechanism 20, actuation of which is effected by the successive compression and release of the bellows element 34 as respectively illustrated in the left-hand and right-hand illustrations in composite view of FIG. 5. In particular, the engagement of the opposite ends of the plunger 26 with the opposite ends of the tubes or other mechanism within the cylinder 24, actually produce the thump-like sounds or beats simulating the heartbeat sounds in a human being or animal, and said sounds readily are transmitted to the earpieces 14 by means of the branch tube members 18, which communicate with the left-hand end of the sound-producing unit 20, as described above. The entire mechanism is relatively simple and readily may be manufactured by molding from appropriate plastic material for uniformity of production of the various elements and easy assembly, and the entire mechanism so closely resembles an actual stethoscope, at least in appearance, that, in conjunction with the sound-producing mechanism of the invention, produces results that are highly entertaining and actually instructive to a child playing with the toy, either in association with another human or a live animal or with a toy doll or toy animal and the like.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy to simulate a heartbeat and a stethoscope connected thereto to permit listening to said beat and comprising in combination, a double-ended bellows element closed at one end and the other end having an opening connected to one end of a flexible tube member, an open-ended cup-like member surrounding said one end of said tube and partially enclosing the end of the bellows connected to said tube, the closed end of said bellows, when expanded, projecting beyond the open end of said cup-like member to permit pressure against said bellows to compress it, a flexible yoke having earpieces respectively on the outer ends of the arms thereof, additional branch tube members interconnected to the other end of said flexible tube, and a sound-producing reciprocable member operable with a body interconnected in series with said tube members and actuated by operation of said bellows element to simulate the sound of a natural heartbeat.

2. The toy according to claim 1 in which said bellows element is formed of flexible material of self-restoring nature and accordian-like in shape and said closed end being adapted to be pushed against an object and then released to cause air pressure and suction consecutively produced by such movement to act upon said reciprocable member to effect said simulated sound of heartbeats.

3. The toy according to claim 1 in which the body within which said reciprocable member operates comprises a tubular sleeve within which said member is slidable between opposite ends of said sleeve to produce said simulated sound of heartbeats, the opposite ends of said sleeve respectively being connected to said tube members.

4. The toy according to claim 3 in which the other end of said flexible tube member is connected to one end of said tubular sleeve and said additional branch tube members having one end of each connected to the other end of said tubular sleeve and the other ends of said branch tube members respectively being connected to said ear pieces.

* * * * *